US007090897B2

(12) United States Patent
Hardesty

(10) Patent No.: US 7,090,897 B2
(45) Date of Patent: Aug. 15, 2006

(54) ELECTRICALLY CONDUCTIVE MDF SURFACE

(76) Inventor: Jon H. Hardesty, 19002 Dallas Pkwy., Apt. 1525, Dallas, TX (US) 75287-3149

( * ) Notice: Subject to any disclaimer, the term of this patent is extended or adjusted under 35 U.S.C. 154(b) by 0 days.

(21) Appl. No.: 10/683,764

(22) Filed: Oct. 10, 2003

(65) Prior Publication Data

US 2005/0079287 A1 Apr. 14, 2005

(51) Int. Cl.

| | |
|---|---|
| ***B05D 1/04*** | (2006.01) |
| ***B05D 1/06*** | (2006.01) |
| ***B05D 1/12*** | (2006.01) |
| ***B05D 1/38*** | (2006.01) |
| ***B05D 3/10*** | (2006.01) |

(52) U.S. Cl. ..... 427/470; 427/485; 427/195; 427/202; 427/427.6; 427/429; 427/439; 427/234

(58) Field of Classification Search ..... 427/458–461, 427/470, 475, 483, 485, 585, 569, 195, 202, 427/427.6, 429, 439, 324

See application file for complete search history.

(56) References Cited

U.S. PATENT DOCUMENTS

| | | | | |
|---|---|---|---|---|
| 3,236,679 | A | 2/1966 | Spiller et al. | |
| 4,360,385 | A | 11/1982 | Grunewalder | |
| 4,454,058 | A | 6/1984 | Savit | |
| 4,686,108 | A * | 8/1987 | Nason et al. | 427/470 |
| 6,153,267 | A * | 11/2000 | Horinka et al. | 427/475 |
| 6,270,853 | B1 * | 8/2001 | Brown et al. | 427/470 |
| 6,548,109 | B1 * | 4/2003 | Hagquist et al. | 427/195 |
| 2002/0033134 | A1 | 3/2002 | Fannon | |
| 2002/0090462 | A1 | 7/2002 | Obie | |
| 2003/0100678 | A1 | 5/2003 | Nicholl et al. | |

FOREIGN PATENT DOCUMENTS

| | | | |
|---|---|---|---|
| EP | 0933140 A1 * | 8/1999 | |
| WO | 97/45591 * | 12/1997 | |
| WO | WO9745591 * | 12/1997 | |

* cited by examiner

*Primary Examiner*—Fred J. Parker
(74) *Attorney, Agent, or Firm*—Greenberg Traurig LLP

(57) ABSTRACT

The present invention provides a method and system for implanting a piece of wood or wood composite to improve the electrostatic attraction thereupon. A method is provided for treating a lignocellulosic substrate such as medium density fiberboard (MDF). The method includes implanting a conductive material into the lignocellulosic substrate, pre-heating the implanted lignocellulosic substrate, coating the pre-heated implanted lignocellulosic substrate with a powder solution, and curing the powder coated substrate.

21 Claims, 4 Drawing Sheets

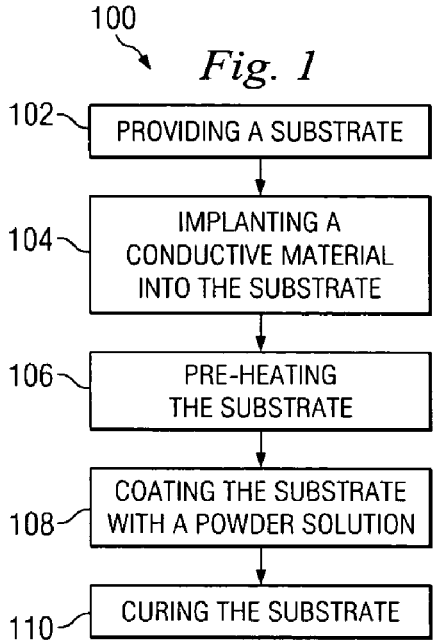
*Fig. 1*
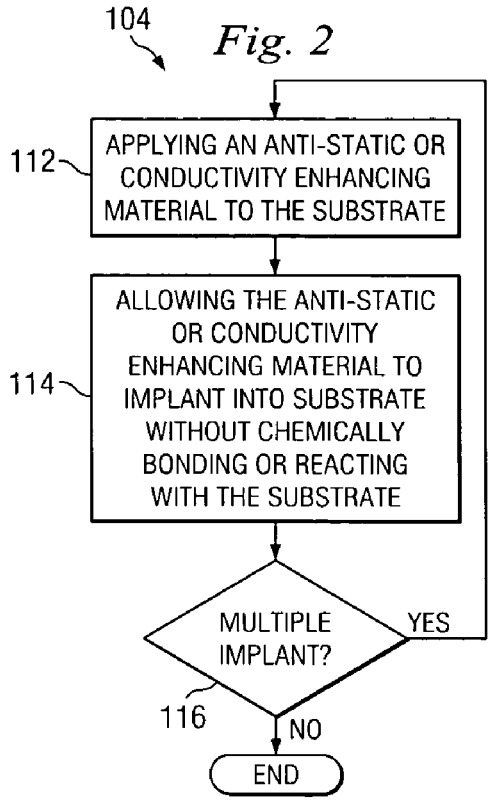
*Fig. 2*
*Fig. 3a*
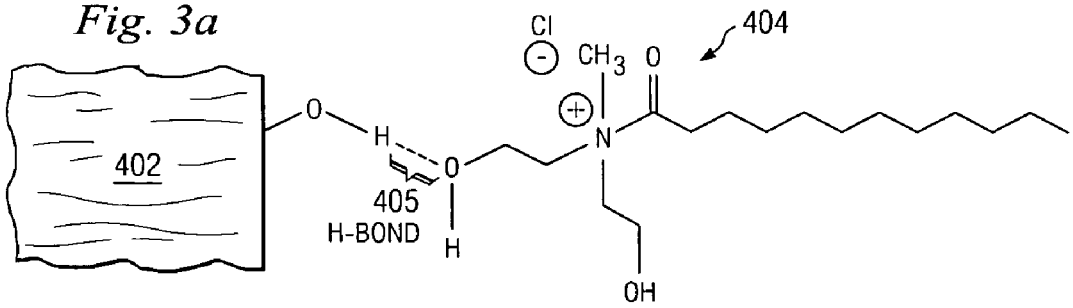
*Fig. 3b*
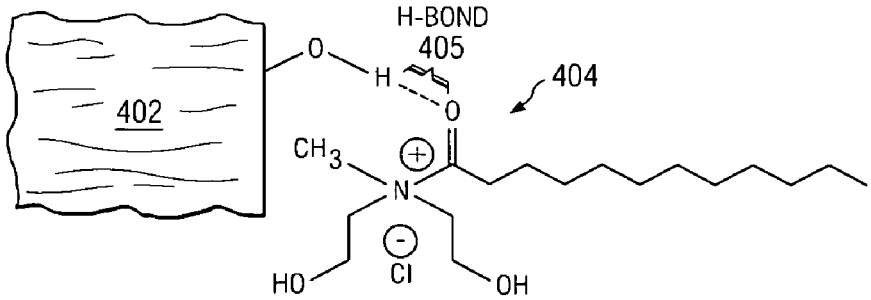

ELECTRICALLY CONDUCTIVE MDF SURFACE

FIELD OF THE DISCLOSURE

The present disclosure relates generally to the field of wood, wood composites, and treatments thereof. More specifically, the present disclosure relates to a method and system for implanting a piece of wood or wood composite to improve the electrostatic attraction thereupon.

BACKGROUND

The diminished availability and high cost of hard woods for use as furniture or attractive building materials has proliferated the use of less expensive wood and wood composites. In many of these cases, the less expensive wood and wood composites are modified or finished such that they appear to be either natural wood or a specific hard wood. Generally, coatings may be applied to a wood or wood composite to provide a protective and/or decorative finish. The coatings may be in the form of a powder (e.g., dry, solventless) or solid solution. These coatings are known to provide a very durable finish.

In a powder coating process, a substrate to be coated can be heated to a specific temperature whereby a solid solution or powder coating may be applied to the surface of the substrate. The powder coating particles are electrically charged and ejected toward the substrate which is electrically grounded, providing an attractive electrostatic force that draws the particles to the substrate. The powdered substrate is heated once again to melt the powder. The resulting liquid flows out to form a continuous film over the surface of the substrate, and in some cases this additional thermal treatment cures the coating to provide a finished article. In those cases where this final heating step does not cure the coating, the coated article must be exposed to some other energy source such as ultraviolet light to cure the coating.

Generally, it is well known that wood and wood composites transmit an electrical ground via the moisture that is naturally present in the wood and wood composite substrate. In order to increase the conductivity of the wood and wood composite substrate, the substrate may be pre-heated prior to the application of the powder coating which forces water from the core of the substrate to the surface enhancing the electrostatic attraction between the substrate and the powder particles. However, it is very difficult to thermally control this migration of moisture without driving it entirely out of the substrate, typically resulting in poor powder coating uniformity and coverage of the article. Certain areas of a machined wood substrate such as edges formed at 90 degree angles and routed areas where large surface areas of highly porous substrate are exposed tend to dry out faster than the bulk areas of the substrate, leading to the condition of inadequate powder coverage and uniformity.

Accordingly, there is a need for a pre-treatment process that provides enhanced electrical conductivity of wood and wood composites prior to the application of a powder coating.

SUMMARY

The present disclosure provides a method and system for implanting a lignocellulosic substrate, such as a piece of wood or wood composite, to improve the electrostatic attraction thereupon. In one embodiment, a method is provided for coating a lignocellulosic substrate. The method comprises implanting a conductive material into the lignocellulosic substrate, pre-heating the implanted lignocellulosic substrate, coating the pre-heated implanted lignocellulosic substrate with a coating (e.g., powder coating or solid solution), and curing the resulting coating.

In another embodiment, a method is provided for implanting a lignocellulosic substrate. The method comprises applying a solution comprising a liquid solvent and an anti-static component to the lignocellulosic substrate, allowing the anti-static component to implant into the surface of the lignocellulosic substrate without chemically bonding or reacting with the lignocellulosic substrate, and removing at least some of the liquid component from the lignocellulosic substrate. The lignocellulosic substrate is thereby enabled to provide an electrically conductive substrate for a subsequent electrostatic coating process.

In another embodiment, a method is provided for powder coating a medium density fiberboard (MDF) substrate. The method comprises treating the MDF substrate with a solution including an amine or amine salt and a solvent, allowing the amine or amine salt to implant into the MDF substrate in a non-chemically bonded mechanism, heating the implanted MDF substrate to remove a majority of the solvent, grounding the heated MDF substrate, and applying a charged coating substance to the grounded MDF substrate.

BRIEF DESCRIPTION OF THE DRAWINGS

FIG. 1 is a flowchart of a method for fabricating a highly conformal and uniform powder coating upon a wood or wood composite substrate.

FIG. 2 is a flowchart of the method of step 104 of FIG. 1.

DETAILED DESCRIPTION

Figure 3C:
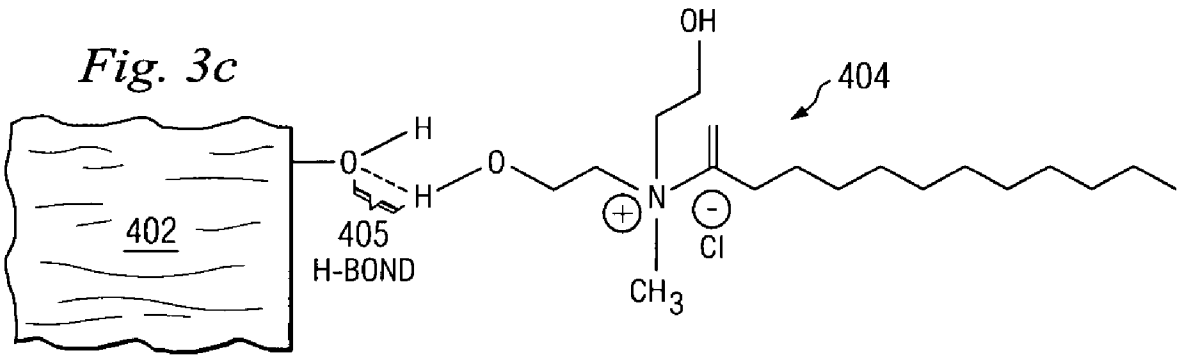
FIG. 3 is a sectional view shows the interaction of the conducting material with the substrate in the method of step 104 FIG. 1.
Figure 3D:
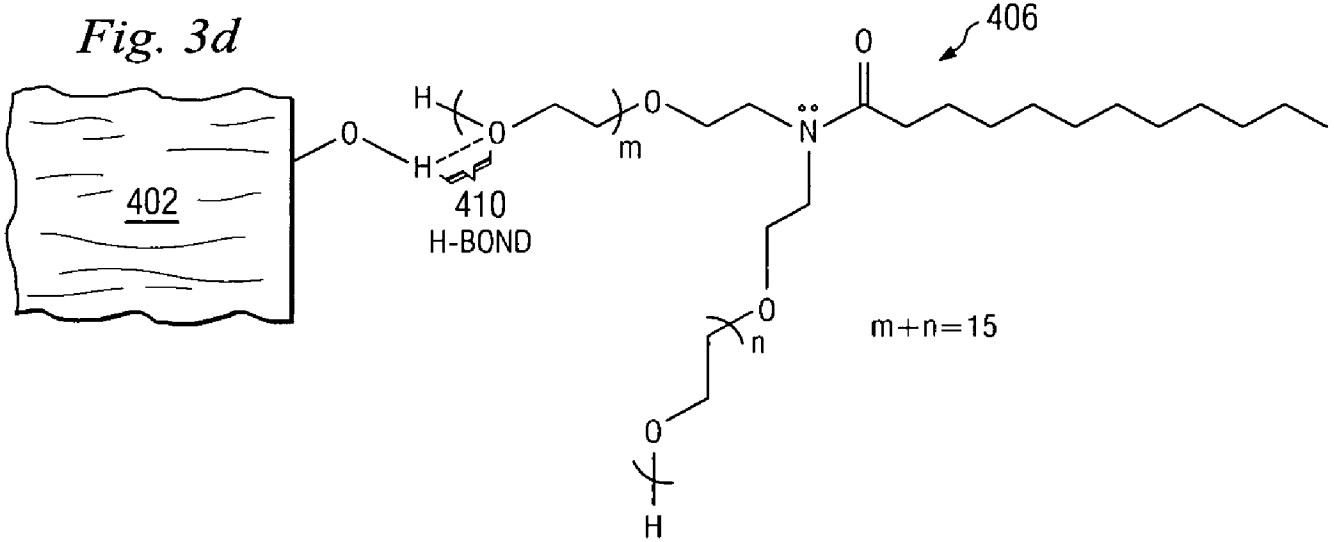
Figure 3E:
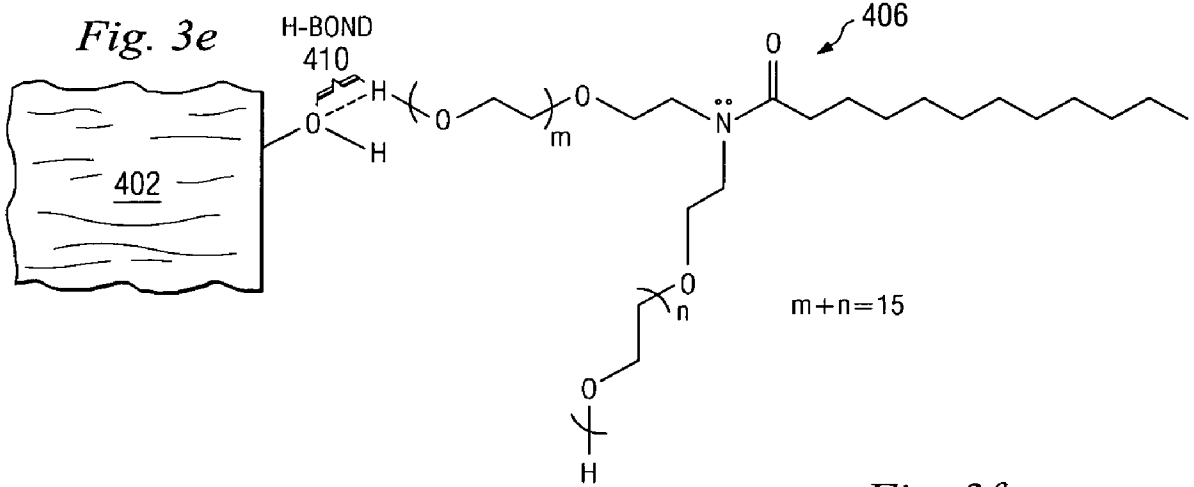
Figure 3F:
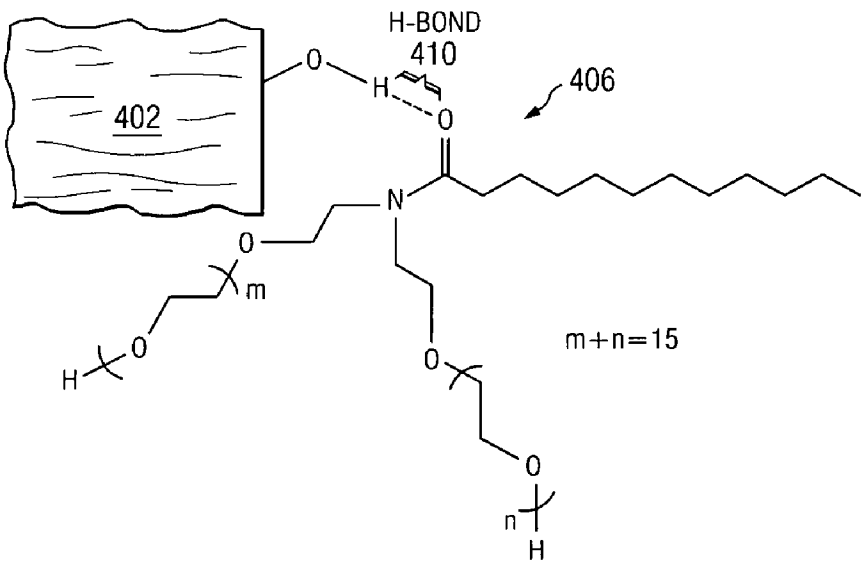

The present disclosure relates to the field of wood and wood composites, as well as treatments for wood and wood composites. More specifically, the present disclosure relates to a method for implanting a lignocellulosic substrate, such as a piece of wood or wood composite, to improve the electrostatic attraction thereupon. To illustrate the disclosure, a specific example and configuration of a medium density fiberboard (MDF) wood composite is illustrated and discussed. It is understood, however, that this specific example is only provided to teach the broader inventive concept, and one of ordinary skill in the art can easily apply the teachings of the present disclosure to other substrates, materials, and structures. Also, it is understood that the substrate and processes discussed in the present disclosure include many conventional methods and materials generally employed in conventional processes.

Referring now to FIG. 1, a method 100 can be used for fabricating a highly conformal and uniform powder coating upon a wood or wood composite substrate. The method 100 may begin at step 102, where a substrate is provided to be processed. The substrate may include solid wood or a wood composite material such as fiberboard, particleboard, strandboard, medium density fiberboard (MDF), or any other porous non-conducting lignocellulosic material.

Next, at step 104, a conductive material is applied proximate to the substrate. The conductive material may include a liquid, solid, gas, or plasma. The conductive material may interact with the surface of the substrate whereby the conductive material or species of the conductive material may diffuse or implant into the surface of substrate. The conductive material may migrate through the pores of the substrate thereby implanting into the upper layers of the substrate. Implantation may include the migration of a liquid by capillary effect, the diffusion of a gas or solid, or the implantation of an ionic species from a low temperature plasma or directed ion beam. A low temperature plasma method may include plasma source ion implantation wherein plasma ions may be accelerated towards the substrate from a proximate plasma source that can be implanted into the substrate. In the present embodiment, there is no covalent bonding of the conductive material and the substrate, and no chemical reaction there between.

In some embodiments, step 104 may be an iterative process by which the conductive material is applied to the substrate. For example, the conductive material may be allowed to implant into the substrate for a specified time. Afterwards, the conductive material may be removed from the substrate and another application of a second conductive material (either the same type of material or a different type) may be performed upon the substrate.

After the application of the conductive material(s) to the substrate at step 104, the substrate may be heated at step 106. This may include a pre-heating of the substrate prior to the application of another material in a subsequent step. Step 106 may include heating of the substrate by a conventional furnace, an infra-red (IR) source, or by a plasma. The substrate may be heated at step 106 in an inert gas or open atmospheric environment. Step 106 may be insitu of step 104, or may be a separate process module. In some embodiments, after step 106, another implantation of the conductive material may be applied to the substrate by step 104, followed by another application of the pre-heating step 106.

Next, at step 108, the pre-heated substrate is coated with a solid solution/powder. The substrate may be attached to a hanger, placed on a conveyor belt, or positioned in a holding apparatus. Alternatively, the substrate may be levitated by a gas applied to a backside of the substrate. This can prevent any coating of the solid solution/powder to the backside of the gas levitated substrate. The substrate may be electrically grounded or may be electrically biased, such as by a direct current (DC) or radio frequency (RF) source. The substrate may also be heated by a conventional furnace, an IR source, or by a plasma. The substrate may be processed at a different temperature than that of the pre-heat temperature of step 106. Powder can be applied along with a flow of gas such as air, $N_2$, $O_2$, or Ar and may be electrically charged. The powder may be electrically charged by ejection through a region of ionized gas or air. The air or gas may be ionized by a plurality of electrodes or by a plasma source, such as a coronal or surface plasma source which can provide charge transfer to the electrically neutral powder particles. Another method for charging the powder may include a method for frictionally creating electric charge whereby the powder may pass over the frictional material to accept a positive electrical charge.

The powder particles are generally organic in composition, such as epoxy, acrylic, or polyester and have the ability to adhere to a substrate by electrostatic attraction. The powder coating that may be deposited upon a substrate may be controlled to provide a variety of different thicknesses. The powder coating thickness may range from 0.001 to 0.100 inches, however generally a powder coating thickness may range from 0.005 to 0.007 inches.

Following step 108, the powder coating may be melt/flowed and cured at step 110. The melt/flow and curing process step 110 can provide a final, durable coating upon the substrate. Step 110 may be carried out in any type of furnace, or by a proximate plasma source. In the case of radiation-cured powder coatings, once the film has been formed by melt/flow, the article is exposed to ultraviolet light or an electron beam to cure the coating. The melt/flow and curing step 110 may include heating by a combination of methods. The heating of the substrate may employ a process temperature range of 100° to 400° F. Step 110 may be carried out insitu of step 108 and/or step 106, whereby the same process tool or module may be employed. Alternatively, step 110 may be completed independently of step 108 and/or step 106.

Referring also to FIG. 2, in one embodiment, step 104 (FIG. 1) may be a multi-step process beginning at step 112, where a conductive or anti-static material is applied proximate to the substrate. The conductive or anti-static material may include a liquid, solid, gas, or plasma. For example, the conductive or anti-static material may be an aqueous or nonaqueous solution of the salts of organic acids, amines, organic sulfonic acids, and/or organic phosphates. The conductive or antistatic material may be a fatty amine salt such as Cocoalkylmethylbis (2-hydroxyethyl) ammonium chloride, sold as ETHOQUAD® C/12 (Akzo Nobel). These materials provide ionic species which can easily implant or diffuse into wood or wood composite substrates and have boiling points higher than the process temperatures of the pre-heating step 106, thereby remaining implanted in the substrate upon thermal cycling. Another class of antistatic materials that may be used are high-boiling amines such as polyoxyethylene (15) cocoalkylamines, sold as ETHOMEEN® C/25(Akzo Nobel). These compounds, chosen to possess chemical structures capable of mimicking the action of moisture naturally present in the substrate, are also notable for the ease with which they are implanted within a porous lignocellulosic substrate. Furthermore, the conductive or antistatic material can be chosen to have a lower bailing point than the process temperature of the steps 106, 108, and 110. Therefore, no change in the electrical conductivity may be lost during the application of any subsequent process that may require an elevated temperature applied to the substrate. The aqueous or non-aqueous solution of conductive material comprising Cocoalkylmethylbis (2-hydroxyethyl) ammonium chloride or polyoxyethylene (15) cocoalkylamines may be applied by any technique such as spraying, dipping, brushing, or vapor deposition. The aqueous or non-aqueous solution may be placed upon the substrate and allowed to implant into the substrate surface. The aqueous or non-aqueous solution may or may not penetrate the entire depth of the substrate, and any excess may be removed from the surface of the substrate by mechanical wiping, cleaning, inert gas or air flow, and/or application of another liquid.

Next at step 114, the conductive material may interact with the surface of the substrate whereby conductive material or species thereof may diffuse or implant into the surface of the substrate. The conductive material may migrate through the pores of the substrate, thereby implanting into the upper layers of the substrate. Implantation may include the migration of a liquid by capillary effect, the diffusion of a gas or solid, or the implantation of ionic species from a low temperature plasma. A low temperature plasma may include any plasma source created by any method of plasma creation such as direct current discharges, radio frequency discharges, capacitive discharges, and inductive discharges. In these types of plasma sources, the plasma temperature proximate to the substrate can be sufficiently lower than the boiling or melting point of the substrate. In the present embodiment, there is no covalent bonding of the conductive material and the substrate, and no chemical reaction there between. After a first implantation of the aqueous or non-aqueous solution, there may be a decision at step 116 wherein steps 112 and 114 may be repeated until a desired implantation depth and concentration is achieved for the substrate.

Therefore, step 104 may be an iterative process, whereby the conductive material is applied to the substrate. The conductive material may be allowed to implant into the substrate for a specified time. After which, the conductive material may be removed from the substrate and another application of the conductive material may be performed upon the substrate. Also as discussed above, in some embodiments, the pre-heating step 106 (FIG. 1) may be executed before the process 104 is repeated.

Referring now to FIG. 3, a sectional view 400 shows the interaction of the conducting material with a substrate 402, such as the one discussed above with regards to step 104. As an aqueous or non-aqueous solution 403, conductive or antistatic material may act analogously to water. Compounds possessing quaternary ammonium salt and additional polar functional groups such as found in Cocoalkylmethylbis(2-hydroxyethyl)ammonium chloride can interact with lignocellulosic surfaces in a fashion similar to water by hydrogen-bonding. In the case of cocoalkylmethylbis(2-hydroxyethyl)ammonium chloride 404, the polar hydroxyl and carbonyl functionalities can provide weak interaction with the OH groups on the surface of the substrate as shown at location 405. Alternatively, in the case of properly chosen amines, such as polyoxyethylene (15) cocoalkylamines, 406 weak interactions between the polar ether, hydroxyl, and carbonyl functionalities of the amine are generated to the free OH moiety present on the lignocellulosic surface as shown at location 410. During step 108 of the method 100, excess water may be evaporated leaving the amine and/or fatty acid quaternary ammonium salt 404 and/or 406 implanted on the substrate 402.

Figure 4:
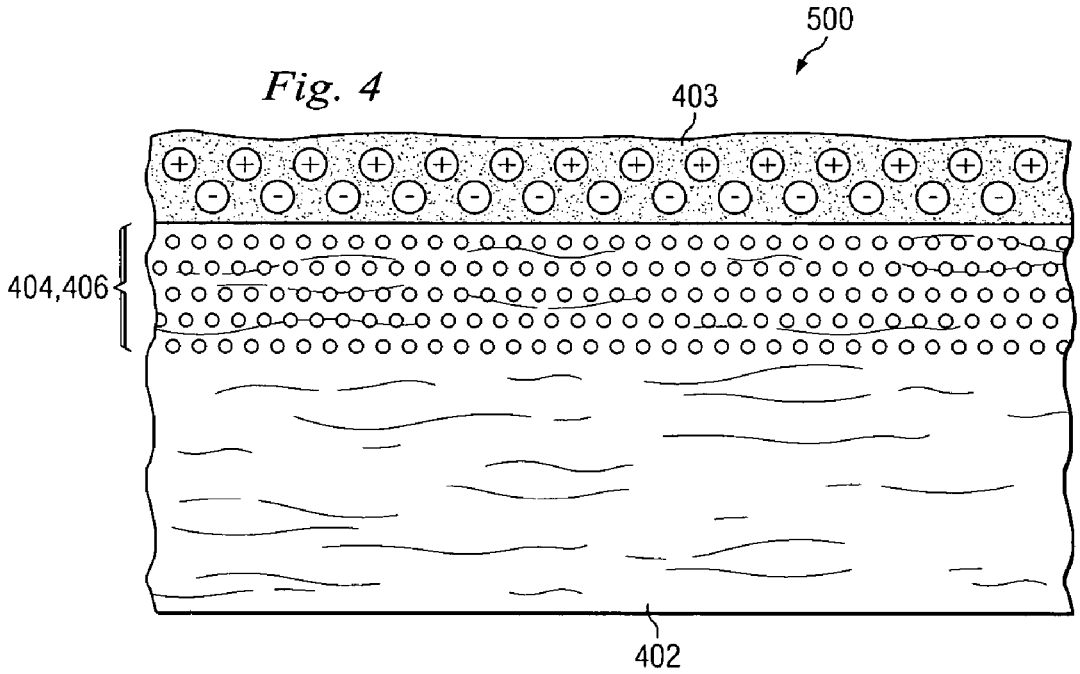
FIG. 4 is a sectional view of a liquid implant upon a substrate.

Referring to FIG. 4, a sectional view 500 of the liquid implant 403 is shown in the substrate 402. The sectional view 500 illustrates the application of a liquid implant 403 which may contain quaternary ammonium salts including any variety of fatty acid 404 and 406, such as Cocoalkylmethylbis(2-hydroxyethyl)ammonium chloride. The liquid implant 403 may further include materials with oligomeric ethyleneoxide side chains and multiple polar amine and ether linkages such as polyoxyethylene (15) cocoalkylamines or any other anti-static compound wherein the boiling point can be lower than the powder coat processing temperatures. The implant liquid 403 may be applied to the substrate 402 by methods including spray, brush, chemical vapor deposition, or immersion. The substrate 402 can include wood, wood composites, or any other non-conductive material. The substrate 402 can be heated prior to and during the implant liquid 403 application. The application of the implant liquid 403 may be performed at a pressure other than atmospheric pressure. For example, the application may be done under a pressurized environment where the pressure may be elevated to further enhance the implantation or diffusion of the liquid implant 403. The pressure may also be further elevated to achieve a supercritical state for a supercritical implant liquid 403, whereby the implant liquid may diffuse or implant into the substrate 402 at a high rate due to the implant liquid being of low viscosity at a supercritical state. Another alternative is the application of the implant liquid 403 to the substrate 402 in a low pressure or vacuum environment. The implant liquid 403 may further be applied to the substrate 402 by chemical vapor deposition, wherein the implant liquid vapor may be created by nebulization, vaporization, or by gas bubbling into a container with the implant liquid. The vapor implant liquid 403 can adhere and implant into the substrate 402 and a greater implant depth 504 may be achieved by vapor application of the implant liquid 403.

After the application of the implant liquid 403, implantation or diffusion can occur. The implant liquid 403 can penetrate the upper surface of the substrate 402 and can migrate through the upper layers of the substrate 402. The liquid implant 403 can implant to an arbitrary implant depth 504. The implant depth 504 may be determined by the selection of implant liquid 403, the process conditions of the implant liquid 403 application, and/or the composition of the substrate 402.

Figure 5:
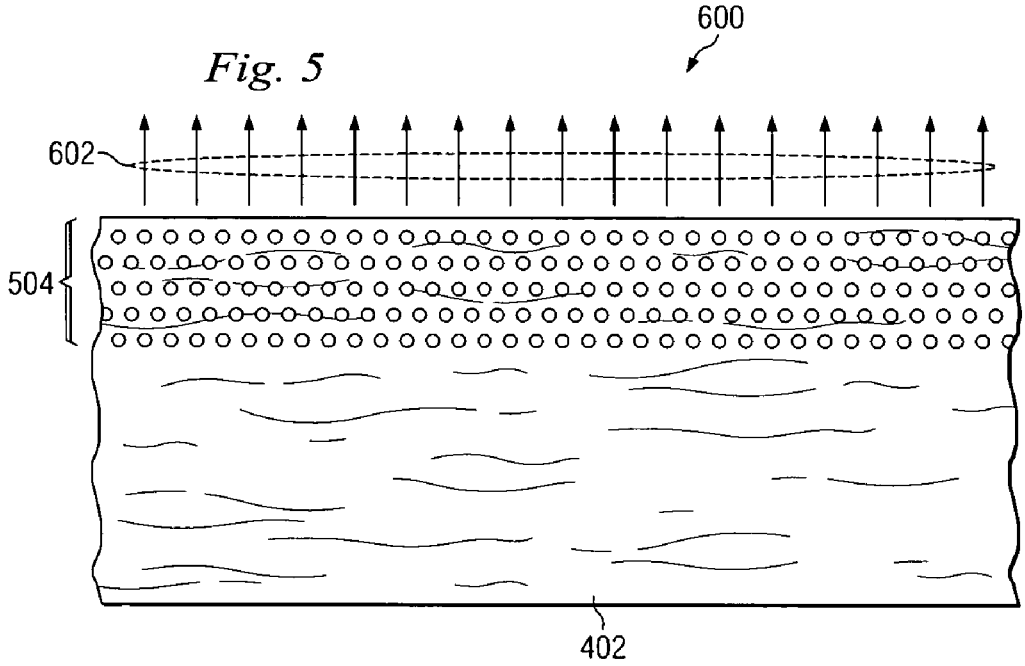
FIG. 5 is a sectional view of the implant depth in a substrate.

Referring now to FIG. 5, a sectional view 600 of the implant depth 504 illustrates the release or removal 602 of any residual implant liquid 403. The removal 602 of any residual implant liquid may involve the application of the pre-heating step 106 of FIG. 1. The removal 602 of the solvent portion of the implant can leave an ionic species implanted within the substrate 402 which can make the surface of the substrate 402 conductive and/or anti-static. The removal 602 process may include heating of the substrate by a conventional furnace, an IR source, or by a plasma. The substrate may be heated at step 106 in an inert gas or open atmospheric environment. The application of step 106 can help drive any liquid compounds from the substrate 402 wherein an ionic implant within the specific implant depth 504 may be accomplished. The ionic concentration and implant depth 504 may be controlled by the step 112 of the application process conditions and the type of implant liquid 403 employed.

The present disclosure has been described relative to a preferred embodiment. Improvements or modifications that become apparent to persons of ordinary skill in the art only after reading this disclosure are deemed within the spirit and scope of the application. It is understood that several modifications, changes and substitutions are intended in the foregoing disclosure and in some instances some features of the disclosure will be employed without a corresponding use of other features. Accordingly, it is appropriate that the appended claims be construed broadly and in a manner consistent with the scope of the disclosure.

What is claimed is:

1. A method for treating a lignocellulosic substrate, the method comprising:

implanting the lignocellulosic substrate with cocoalkylamine that increases the conductivity of the lignocellulosic substrate without covalently bonding to the lignocellulosic substrate or chemically reacting with the lignocellulosic substrate;

pre-heating the implanted lignocellulosic substrate;

coating the pre-heated implanted lignocellulosic substrate with a powder coating; and curing the powder coated substrate.

2. The method of claim 1 wherein the lignocellulosic substrate comprises a wood or wood composite.

3. The method of claim 1 wherein the conductive material is in a liquid form.

4. The method of claim 3 wherein the liquid conductive material is implanted into the substrate by spraying, dipping, brushing, or chemical vapor deposition.

5. The method of claim 1 wherein the conductive material is in a gaseous form.

6. The method of claim 5 wherein the gas conductive material is implanted into the substrate by chemical vapor deposition, plasma source ion implantation, or diffusion.

7. The method of claim 1 wherein the conductive material is in a solid form.

8. The method of claim 7 wherein the solid conductive material is implanted into the substrate by diffusion.

9. The method of claim 1 wherein the substrate is preheated by a furnace, or infra-red heat source.

10. The method of claim 1 wherein the powder is selected from the group consisting of epoxy, acrylic, and polyester.

11. The method of claim 1 wherein the powder is cured thermally, via ultraviolet light radiation, or via electron-beam radiation.

12. A method for implanting a lignocellulosic substrate, the method comprising:

applying a solution comprising a liquid component and a cocoalkylamine to the lignocellulosic substrate;

allowing the cocoalkylamine to implant into the lignocellulosic substrate to increase the conductivity of the lignocellulosic substrate without covalently bonding or chemically reacting with the lignocellulosic substrate; and removing at least some of the liquid component from the lignocellulosic substrate whereby the lignocellulosic substrate is enabled to provide an electrically conductive substrate for a subsequent electrostatic coating process.

13. The method of claim 12 wherein removing at least some of the liquid component includes heating the lignocellulosic substrate.

14. The method of claim 13 wherein the application of solution to the lignocellulosic substrate is repeated after the heating.

15. The method of claim 13 wherein the application of solution to the lignocellulosic substrate is repeated prior to the heating.

16. The method of claim 12 wherein the cocoalkylamine comprises a polyoxyethylene cocoalkylamine.

17. The method of claim 12 wherein the cocoalkylamine is Cocoalkylmethylbis(2-hydroxyethyl) ammonium chloride.

18. The method of claim 12 wherein the cocoalkylamine is polyoxyethylene (15) cocoalkylamines.

19. A method for powder coating a medium density fiberboard (MDF) substrate, the method comprising the steps of:

treating the MDF substrate with a solution including a cocoalkylamine and a solvent;

allowing the cocoalkylamine to implant into the MDF substrate to increase the conductivity of the MDF substrate without covalently bonding or chemically reacting with the MDF substrate;

heating the implanted MDF substrate to remove a majority of the solvent;

applying an electrical voltage to the heated MDF substrate; and applying a charged coating substance to the voltage applied MDF substrate.

20. The method of claim 19 wherein the applied voltage is electrical ground.

21. The method of claim 19 wherein the heating step is performed at a substrate temperature from about 100° to 400° F.

* * * * *